US006953318B2

(12) United States Patent
Krügerke

(10) Patent No.: US 6,953,318 B2
(45) Date of Patent: Oct. 11, 2005

(54) VOLUMETRIC CONTROL FOR BLOWER FILTER DEVICES

(75) Inventor: Thomas Krügerke, Berlin (DE)

(73) Assignee: MSA Auer GmbH (DE)

( * ) Notice: Subject to any disclaimer, the term of this patent is extended or adjusted under 35 U.S.C. 154(b) by 0 days.

(21) Appl. No.: 10/258,224

(22) PCT Filed: Apr. 6, 2001

(86) PCT No.: PCT/DE01/01456

§ 371 (c)(1),
(2), (4) Date: May 27, 2003

(87) PCT Pub. No.: WO01/80952

PCT Pub. Date: Nov. 1, 2001

(65) Prior Publication Data

US 2003/0180149 A1 Sep. 25, 2003

(30) Foreign Application Priority Data

Apr. 27, 2000 (DE) ..... 100 21 581

(51) Int. Cl.[7] ..... F01B 25/00
(52) U.S. Cl. ..... 415/26; 415/118; 128/201.29
(58) Field of Search ..... 415/26, 47, 118; 128/200.27, 200.28, 201.29, 202.11, 202.12, 204.18, 205.22, 205.26

(56) References Cited

U.S. PATENT DOCUMENTS 5,322,058 A 6/1994 Pasternack
5,950,621 A 9/1999 Klockseth et al.

FOREIGN PATENT DOCUMENTS

EP 0 352 938 A2 1/1990
FR 2 680 467 2/1993

*Primary Examiner*—Edward K. Look
*Assistant Examiner*—Dwayne J. White
(74) *Attorney, Agent, or Firm*—Wood, Phillips, Katz, Clark & Mortimer

(57) ABSTRACT

The invention relates to a volumetric control for blower filter devices in which a control unit (5) determines a differential pressure between measuring points (1, 2) that is converted into a control signal for the fan output. To this end, at least two measuring points (1, 2) are arranged in the airflow behind the fan impeller (3) and in front of the consumer, in particular, the breathing hood (4). The measuring points (1, 2) can be located in the airflow inside the case filter device behind the impeller wheel (3) and in front of the outlet of the blower filter device or one measuring point is placed in the airflow inside the housing of the case filter device behind the impeller wheel (3) and one is placed in the vicinity of the connection of the breathing hood (4) or both measuring points are located in the breathing hose (8).

17 Claims, 2 Drawing Sheets

VOLUMETRIC CONTROL FOR BLOWER FILTER DEVICES

BACKGROUND OF THE INVENTION

1. Field of the Invention

This invention relates to a volumetric control system for blower filter devices that is particularly suited for a breathing hood connection.

2. Background Art

State-of-the-art blower filter devices are characterized by the disadvantage that the flow of air supplied to the hood varies depending on how clogged the filter is. When the filter is new and clean, more air passes through the filter as is required in accordance with applicable standards in a given individual case. Similar problems occur when different filters are to be used.

The resulting disadvantages are increased power consumption and increased air throughput. Another problem arising with the gradual clogging of the filter is that it is not known when the flow of air supplied to the hood falls below the required quantity. Another problem is that the type of breathing connection that is used for the breathing hood influences the volumetric air flow.

Various types of volumetric controls have been designed to remedy this problem. EP 0 35 29 38 A2 proposes to measure the differential pressure between a measuring point in front of, and a measuring point behind, the impeller wheel of the fan and to use this signal for controlling the blower speed.

EP 0 62 10 56 A1 proposes to measure the dynamic pressure at the outlet of the blower filter device. The dynamic pressure is produced by the flow resistance of the hood and can also be used as a measure of volumetric air flow. In addition, this design features another sensor of the thermistor type in a side duct that monitors preset volumetric air flow limits and triggers an alarm signal when the air flow drops below these limits.

Fl 80606 describes a design in which the fan motor is used as a detector so that the electrical control circuit measures the power drawn by the fan motor and the effective voltage at its poles. The design uses the properties of the rotary blower, as the air volume that flows through the blower per time unit is proportional to the rotor torque, and the pressure difference is proportional to the rotational speed. This solution is improved by DE 195 02 360 A1 in that the fan output is controlled based on current and rotational speed.

Despite this comprehensive development effort, no one as yet has succeeded in keeping the volumetric air flow constant regardless of the filters and hoods that are used. Dynamic pressure measurement behind the fan or negative pressure measurement behind the fan can only be used to measure volumetric flow if the flow resistance values of the hood or filters are known. This means for practical purposes that the flow resistance values of filters and hoods have to be kept constant at narrow tolerances during production in order for these methods to work.

SUMMARY OF THE INVENTION

It is one aim of this invention to keep the volumetric flow constant within tolerance ranges regardless of the filters and hoods used. This is accomplished through the characterizing features of claim 1 while advantageous embodiments are the subject of the dependent claims herein.

According to the invention, a control unit controls the volumetric flow of blower filter devices by determining a differential pressure between measuring points and converting it into a control signal while at least two measuring points are arranged in the air flow behind the fan impeller wheel and in front of the consumer, in particular, the breathing hood. A number of tests have proven that the pressure difference in this measuring arrangement depends on volumetric air flow but is largely independent of the flow resistance of the filter(s) and the breathing connection at the breathing hood.

DETAILED DESCRIPTION OF THE DRAWINGS

Figure 1:
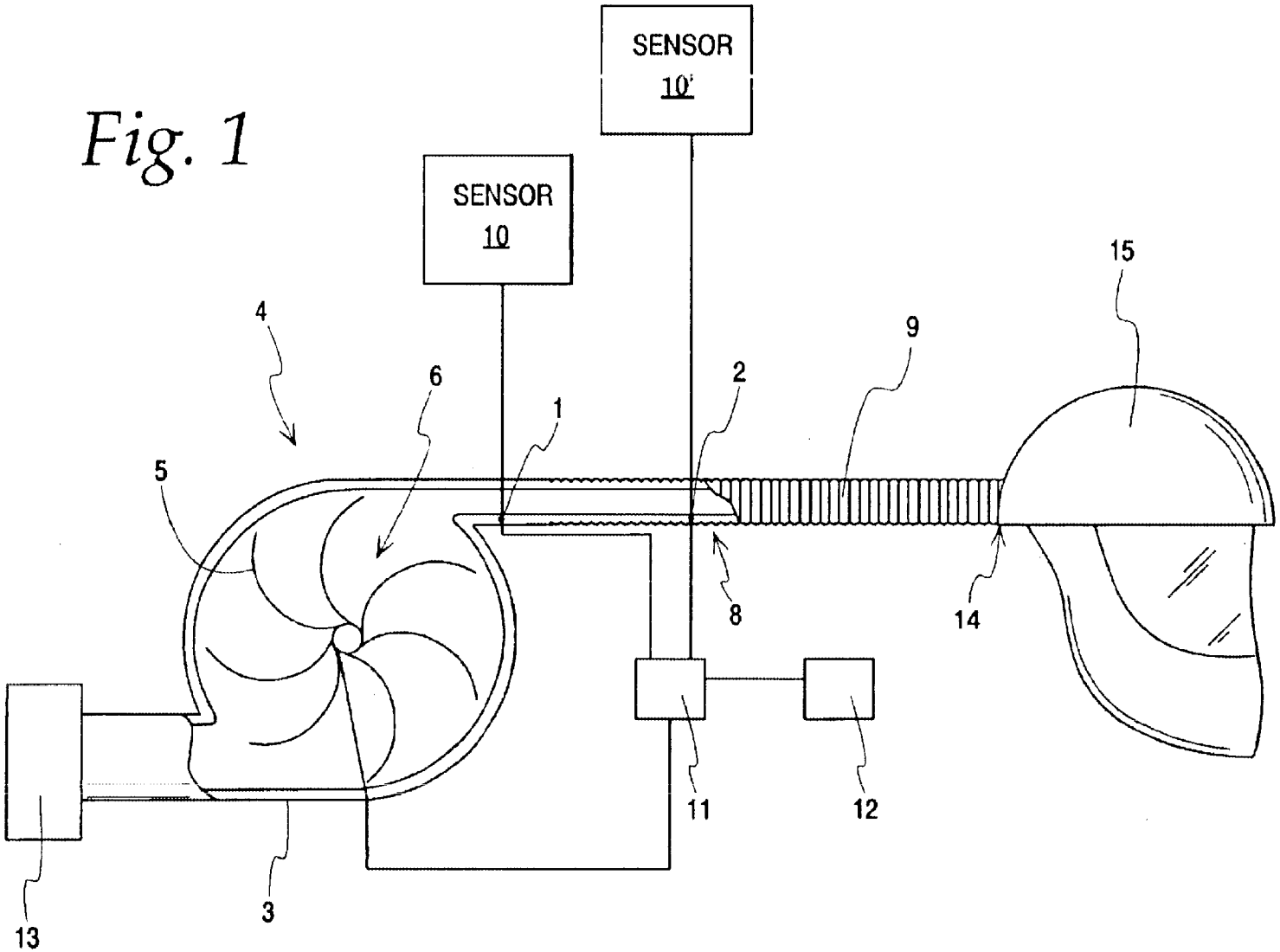
FIG. 1 is a partially schematic representation of one form of volumetric control system, according to the invention, for a blower filter device that communicates filtered air to a breathing hood through a breathing hose, wherein the volumetric control system is operable using sensors at first and second different measuring points.

The volumetric control for blower filter devices, as seen in FIG. 1, consists of the measuring points 1, 2 that are located in the air flow within a case 3 on a blower filter device 4 behind/downstream an impeller wheel 5 on a fan 6 and in front/upstream of the blower filter device outlet 8 towards a breathing hose 9. Pressure sensors 10,10' are placed at the measuring points 1, 2, and a control unit 11 determines the differential pressure between them and converts it into a control signal for the output to thereby adjust the output of the impeller wheel. A signaling device 12 is activated when the volumetric air flow cannot be adjusted to a desired level in this way.

With this measuring point arrangement, the pressure difference depends on the volumetric air flow but is largely independent of the flow resistance of the filter(s) 13 and the breathing connection at 14 between the breathing hose 9 and the breathing hood 15. In this way, the volumetric air flow can be kept constant within tolerance ranges regardless of the filter(s) 13 and breathing connection at 14 for breathing hoods 15 used.

In a preferred embodiment, the measuring points 1,2 are positioned in the air flow within the blower filter device 4 behind/downstream the impeller wheel 5 and in front/upstream of the outlet 8 of the blower filter device 4. The pressure sensors 10,10' and control equipment with power supply can thus be integrated in an optimum way into a compact unit with the blower filter device 4.

Figure 2:
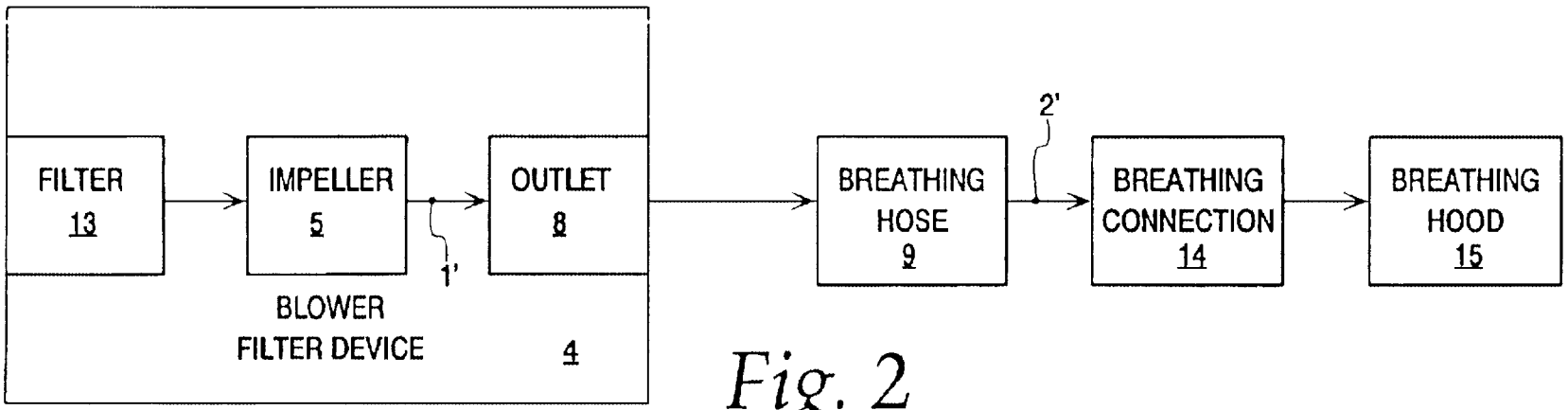
FIG. 2 is a schematic representation of a volumetric control system, according to the invention, for a blower filter device that communicates filtered air to a breathing hood through a breathing hose, wherein the volumetric control system is operable using a different combination of sensor locations.
Figure 3:
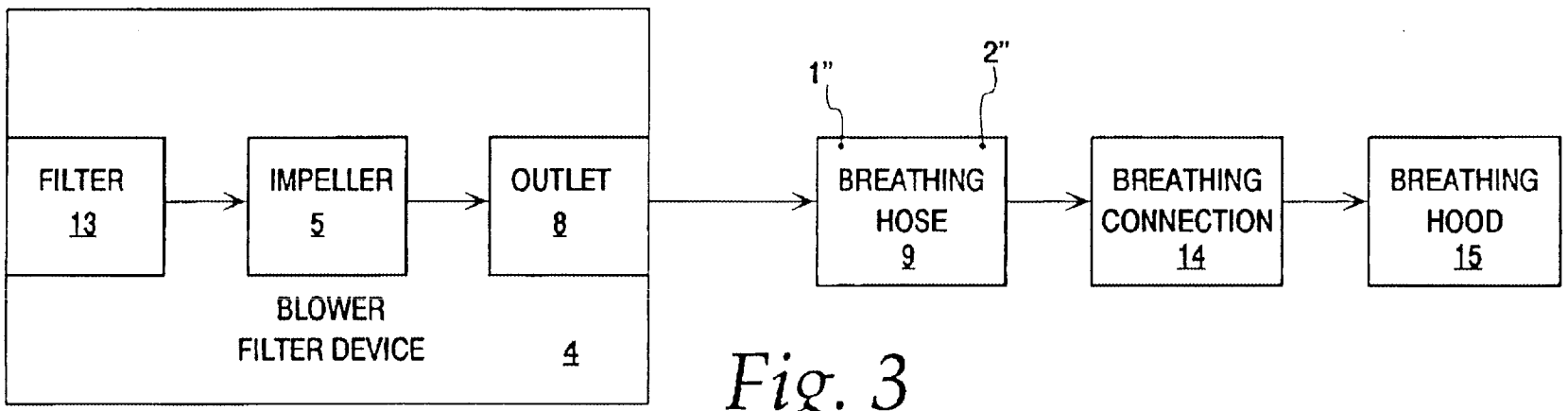
FIG. 3 is a view as in FIG. 3 wherein the volumetric control system is operable using a further combination of sensor locations.

Alternatively, as shown in FIG. 2, one measuring point 1' can be positioned behind the impeller wheel 5 and another measuring point 2' in front of the breathing connection 14 between the breathing hood 15 and the breathing hose 9, or, as shown in FIG. 3, both measuring points 1",2" can be placed in the breathing hose 9. It is always an advantage when the spacing of the two measuring points within the airflow portions described is as wide as is feasible within the dimensions of the system and its components.

The control unit 11 compares the pressure difference with preset limiting values. If the pressure difference is outside preset limiting values, the control unit 11 tries to set the volumetric air flow to the desired level (such as 125 l/min to 140 l/min) by adjusting the impeller wheel output. If this cannot be done, the signaling device 12 is activated that alerts the user. This can be arranged by linking a measuring system with the fan 6 in such a way that the signaling device 12 is activated whenever the fan output exceeds or falls below limits, or by linking the signaling device 12 with the control unit 11 in such a way that the signaling device 12 is activated when the differential pressure exceeds or falls below a predetermined/preset differential pressure.

I claim:

1. A volumetric control system for a blower filter device comprising a filter and an impeller wheel that causes air to be drawn through the filter and directed downstream through an outlet to and through a breathing hose that communicates air from the blower filter device outlet to a breathing hood through a breathing connection, between the breathing hose and breathing hood, wherein a control unit determines a differential pressure between measuring points and converts the differential pressure into a control signal, wherein at least two measuring points are arranged with a first of the measuring points in air flow downstream of the impeller wheel and a second of the measuring points downstream of the first measuring point and upstream of the breathing connection between the breathing hose and breathing hood.

2. The volumetric control system according to claim 1, wherein a signaling unit is provided that is linked to the control unit in such a way that the signaling device is activated whenever a differential pressure exceeds or falls below a predetermined differential pressure.

3. The volumetric control system according to claim 1, wherein the first measuring point is located in the air flow within a case on the blower filter device downstream of the impeller wheel and the second measuring point is located in the air flow downstream of an outlet for the blower filter device.

4. The volumetric control system according to claim 3, wherein a signaling unit is provided that is linked to the control unit in such a way that the signaling device is activated whenever a differential pressure exceeds or falls below a predetermined differential pressure.

5. A volumetric control system for a blower filter device comprising a filter and an impeller wheel that causes air to be drawn through the filter and directed downstream through an outlet to and through a breathing hose that communicates air from the blower filter device outlet to a breathing hood through a breathing connection, between the breathing hose and breathing hood, wherein a control unit determines a differential pressure between measuring points and converts the differential pressure into a control signal, wherein at least two measuring points are arranged with a first of the measuring points in air flow downstream of the impeller wheel and a second of the measuring points upstream of the breathing connection between the breathing hose and breathing hood, wherein the control unit adjusts an output for the impeller wheel in the event that the control unit determines that the differential pressure exceeds or falls below predetermined limiting values.

6. A blower filter device with a volumetric control system comprising: a fan with an impeller wheel; a filter upstream of said impeller wheel; a blower filter device output, the fan residing in a case defining a blower filter device output; and a control unit operated by a differential pressure between two measuring points and connected to said fan, said blower filter device output being connected to a breathing hood via a breathing hose that connects to the blower filter device output and communicates air from the blower filter device output downstream to a breathing hood through a breathing connection between the breathing hose and breathing hood, at least two measuring points are arranged in air flow downstream of the fan impeller wheel and upstream of the breathing connection between the breathing hose and breathing hood, wherein a signaling device is linked to the control unit connected to the measuring points that is activated when measured values deviate from a specified differential pressure and/or a predetermined fan output.

7. The blower filter device according to claim 6, wherein the measuring points are located downstream of the fan impeller wheel and upstream of the blower filter output.

8. The blower filter device according to claim 6, wherein the measuring points are located downstream the fan impeller wheel and adjacent to the breathing connection of the breathing hose to the breathing hood.

9. The blower filter device according to claim 6, wherein the measuring points are located in the breathing hose.

10. A volumetric control system for a blower filter device comprising a filter and an impeller wheel that causes air to be drawn through the filter and directed downstream through an outlet to and through a breathing hose that communicates air from the blower filter device outlet to a breathing hood through a breathing connection, between the breathing hose and breathing hood, wherein a control unit determines a differential pressure between measuring points and converts the differential pressure into a control signal, wherein at least two measuring points are arranged with a first of the measuring points in air flow downstream of the impeller wheel and a second of the measuring points upstream of the breathing connection between the breathing hose and breathing hood, wherein the first measuring point is located in the air flow within a case on the blower filter device downstream of the impeller wheel and the second measuring point is located upstream of the breathing connection between the breathing hose and breathing hood adjacent to the breathing connection between the breathing hose and breathing hood.

11. The volumetric control system according to claim 10, wherein the control unit adjusts an output for the impeller wheel in the event that the control unit determines that the differential pressure exceeds or falls below predetermined limiting values.

12. The volumetric control system according to claim 10, wherein a signaling unit is provided that is linked to the control unit in such a way that the signaling device is activated whenever a differential pressure exceeds or falls below a predetermined differential pressure.

13. A volumetric control system for a blower filter device comprising a filter and an impeller wheel that causes air to be drawn through the filter and directed downstream through an outlet to and through a breathing hose that communicates air from the blower filter device outlet to a breathing hood through a breathing connection, between the breathing hose and breathing hood, wherein a control unit determines a differential pressure between measuring points and converts the differential pressure into a control signal, wherein at least two measuring points are arranged with a first of the measuring points in air flow downstream of the impeller wheel and a second of the measuring points upstream of the breathing connection between the breathing hose and breathing hood, wherein both of the first and second measuring points are located in the breathing hose.

14. The volumetric control system according to claim 13, wherein the impeller wheel in the event that the control unit determines that the differential pressure exceeds or falls below predetermined limiting values.

15. The volumetric control system according to claim 13, wherein a signaling unit is provided that is linked to the control unit in such way that the signaling device is activated whenever a differential pressure exceeds or falls below a predetermined differential pressure.

16. The volumetric control system according to claims 1, 3, 10, or 13 wherein the spacing of the measuring points is as great as is possible with a particular configuration for the blower filter device and breathing hose.

17. A volumetric control system for a blower filter device comprising a filter and an impeller wheel that causes air to be drawn through the filter and directed downstream through an outlet to and through a breathing hose that communicates air from the blower filter device outlet to a breathing hood through a breathing connection, between the breathing hose and breathing hood, wherein a control unit determines a differential pressure between measuring points and converts the differential pressure into a control signal, wherein at least two measuring points are arranged with a first of the measuring points in air flow downstream of the impeller wheel and a second of the measuring points upstream of the breathing connection between the breathing hose and breathing hood, wherein the measuring points are located in the air flow within a case on the blower filter device downstream of the impeller wheel and upstream of the blower filter device outlet, wherein the control unit adjusts an output for the impeller wheel in the event that the control unit determines that the differential pressure exceeds or falls below predetermined limiting values.

* * * * *